US007160163B2

(12) United States Patent
Gai

(10) Patent No.: US 7,160,163 B2
(45) Date of Patent: Jan. 9, 2007

(54) STEERING DEVICE, PARTICULARLY FOR MARINE OUTBOARD ENGINES

(75) Inventor: Giorgio Gai, Busalla (IT)

(73) Assignee: Ultraflex SpA, Busalla (IT)

( * ) Notice: Subject to any disclaimer, the term of this patent is extended or adjusted under 35 U.S.C. 154(b) by 26 days.

(21) Appl. No.: 10/868,196

(22) Filed: Jun. 16, 2004

(65) Prior Publication Data

US 2004/0259437 A1 Dec. 23, 2004

(30) Foreign Application Priority Data

Jun. 17, 2003 (IT) ..... SV2003A0027

(51) Int. Cl.
*B63H 21/26* (2006.01)

(52) U.S. Cl. ..... 440/615; 440/53

(58) Field of Classification Search ..... 440/53, 440/59, 61 R, 61 S, 63; 114/150, 144 R; 91/417 R See application file for complete search history.

(56) References Cited

U.S. PATENT DOCUMENTS

| | | | | |
|---|---|---|---|---|
| 4,373,920 A | | 2/1983 | Hall et al. | 440/59 |
| 4,773,882 A | | 9/1988 | Rump | 440/61 R |
| 5,002,510 A | | 3/1991 | Rump | 440/61 R |
| 5,074,193 A | * | 12/1991 | Hundertmark | 91/417 R |
| 5,092,801 A | | 3/1992 | McBeth | 440/61 R |
| 5,392,690 A | * | 2/1995 | Hundertmark | 91/417 R |
| 5,542,864 A | | 8/1996 | Peebles | 440/61 R |
| 5,601,463 A | * | 2/1997 | Kobelt | 440/61 R |
| 5,643,022 A | | 7/1997 | Wagner | 440/61 R |
| 5,658,177 A | | 8/1997 | Wagner | 440/61 R |
| 5,934,956 A | * | 8/1999 | Michel et al. | 440/61 R |
| 5,997,370 A | | 12/1999 | Fetchko et al. | 440/61 R |

* cited by examiner

*Primary Examiner*—Lars A. Olson
(74) *Attorney, Agent, or Firm*—James Creighton Wray

(57) ABSTRACT

Hydraulic steering device for outboard motors having an end for fastening to transoms of watercrafts. The motor/propeller assembly is mounted on the end to rotate about a substantially vertical steering axis. A closed hydraulic circuit has at least one pump driven by steering unit and at least one double-acting cylinder which is slideably fitted on at least one coaxial rod. The rod sealingly projects out of a cylinder head and carries a separating piston which divides the cylinder into two variable volume chambers. At least one of the inlets/outlets of at least one of the two chambers is formed by the at least one rod. The rod has an axial hole extending from its outer end to one or more ports for communication with corresponding chambers of the cylinder. The ports are arranged to be adjacent to the piston side turned toward the cylinder head from where the rod projects.

27 Claims, 6 Drawing Sheets

STEERING DEVICE, PARTICULARLY FOR MARINE OUTBOARD ENGINES

This application claims the benefit of Italian Application No. SV2003A000027 filed Jun. 17, 2003.

BACKGROUND OF THE INVENTION

The present invention relates to a steering device, particularly for marine outboard engines, which outboard engines have a clamping and/or gripping end for fastening them to the transom of a watercraft on which the motor and propeller assembly is mounted in such a manner as to rotate about a substantially vertical steering axis, and which steering device includes a closed hydraulic circuit having at least one pump driven by steering means, such as a steering wheel, a helm or the like and at least one double-acting cylinder which is slideably fitted on at least one coaxial rod, which rod sealingly projects out of a cylinder head and carries a separating piston which divides the cylinder into two variable volume chambers, each of which chambers has a hydraulic fluid inlet/outlet, each being connected to one of two inlets/outlets of the pump and with sealing heads for the mutually sliding cylinder and rod which are made of one piece with the cylinder, to at least one plate or bracket for securing the cylinder and rod assembly to the transom and/or to the end for fastening the motor to the transom, the bracket being non slideably attached to the at least one rod, at least one idler arm between the cylinder and outboard motor steering connection means which are integral with the motor.

Such devices are well known in the art and widely used. While these devices satisfactorily serve their function, they still suffer from certain drawbacks.

First, in these known devices, the rod is secured to the transom, whereas the cylinder slides along the rod. At its two opposite ends, the cylinder has one inlet/outlet respectively for feeding and discharging a fluid, typically oil, from each of the two piston-separated chambers. Since the cylinder moves along the rod, such connection shall be provided for each inlet and outlet by hoses, interposed between one end of each fluid feed conduit for each corresponding chamber and the corresponding chamber itself. Due to the rigidity required of the hoses, the continuous sliding motion of the cylinder causes their material to be stressed and possibly broken with time, especially in the portions extending from the transom to the cylinder fittings.

Further drawbacks in prior art devices are also associated to the way the rod is fastened to the stationary portion of the transom and/or to the clamp to be fastened to said transom of the motor. Here, normal prior art steering systems have brackets for coupling or attaching the rod to the transom, which brackets often have the serious drawback of not being adaptable to all commercially available watercrafts. Fastening arrangements for currently available cylinders also have the drawback of requiring totally different mounting methods, as the cylinder needs to be adapted by using shims depending on the type of motor being used. Unfortunately, this is a considerable problem, because each motor requires the length of the motor tube to be adjusted to the length between the mounting brackets. The problem is that mounting instructions shall be given for each motor (number, positioning and thickness of shim washers), thereby increasing mounting costs. Further, upon insertion of these shim washers, the small clearance that still exists is compensated for by using a ring nut and secured by a dowel. Therefore, apparent dowel access problems arise, as well as the expected ring nut loosening problems associated thereto.

SUMMARY OF THE INVENTION

The object of the present invention is to provide a steering device according to the preamble of claim 1, which might simply and inexpensively obviate the drawbacks of known steering devices.

The invention fulfils the above objects thanks to a steering device according to the preamble of claim 1, wherein at least one of the inlets/outlets of at least one of the two cylinder chambers is formed by the at least one rod which has an axial hole extending from its outer end to one or more ports for communication with the corresponding chamber of the cylinder, which ports are arranged to be adjacent to the piston side turned toward the cylinder head wherefrom said rod projects.

An advantageous embodiment of the steering device of this invention comprises a cylinder actuator having one rod projecting out of both cylinder heads and carrying an intermediate separating piston which divides the cylinder into two chambers and the rod into two coaxial half-stems, the inlets/outlets of each chamber being formed by a through hole of the associated half-stem, which hole extends to the outer end of said half-stem and opens into the corresponding chambers with ports adjacent to the wall of the separating piston, on the side thereof turned toward the corresponding outlet head of the cylinder half-stem.

Thanks to this construction, the inlets/outlets of the two cylinder chambers are situated in stationary portions of the steering device, whereby the hoses of said circuit are not expected to be moved. This eliminates the above drawbacks, and further allows to considerably enhance the safety of the steering system, thanks to the fact that the latter has no moving parts, and the fluid feed conduits may be covered all through their length, for instance to the corresponding connection with the rod. By eliminating the cylinder inlets/outlets, the advantage is also provided of avoiding any movable projecting parts, whose position or orientation changes with the steering angle. This provides technical advantages, such as a lower risk that the hoses may be broken or damaged, and is further advantageous for the safety of people aboard. In fact, there are no longer flexible members that form loops having changing radiuses and/or positions, and that may be stumbled over by people or entangle other watercraft equipment.

The cylinder is a double-acting cylinder having no fluid inlet on its outer surface, oil being admitted into the rod, through appropriate channels that will be described hereafter; thus a wholly rigid structure is provided, except the cylinder that obviously is expected to move in order to steer the watercraft.

Moreover, the steering device of this invention includes a fastening plate, or bracket, which connects the cylinder rod to the transom and has particular shapes, to allow quick mounting, while providing lightness and sturdiness, thanks to the provision of stiffening ribs formed thereon.

According to another characteristic, the fastening plate or bracket of the steering device has one or more holes coincident with one or more holes formed on one portion of the clamp for securing the motor to the transom, there being provided means for fastening the bracket or plate to the clamp, e.g. bolts or the like. In accordance with a further alternative arrangement, the plate is designed to be coupled, at the opposite end, to the cylinder, by a block which is adapted for engagement onto the fastening terminal of the motor. Most of currently available outboard motors have threaded holes in the clamp which are in a substantially identical position for a large number of motors, which holes allow to secure the motor against rotation of the propelling assembly while the latter is packaged for sale and/or transport. Hence, said fastening holes provide pre-set fastening points, having a pre-set position, which is mostly identical for the different motor types, whereby they avoid the provision of complex bracket or plate fastening arrangements or adjustments. In order to adapt the plate to different positions of the holes in the clamp of the different motor types, the plate may have different holes at different positions, or at least some of the holes with the shape of a slot or a cross.

The steering device of the invention further includes an idler arm, possibly integral with the cylinder, which has a particular configuration, as it is bent at several locations, to be easily adapted to most of currently available outboard motors.

Further characteristics and improvements will form the subject of the claims appended hereto.

The characteristics of the invention and the advantages derived therefrom will be more apparent from the following detailed description of the detailed figures, in which:

BRIEF DESCRIPTION OF THE DRAWINGS

FIG. 2 is a rear perspective view of the embodiment as shown in FIG. 1 of the device according to the invention.

DETAILED DESCRIPTION OF THE PREFERRED EMBODIMENTS

Figure 1:
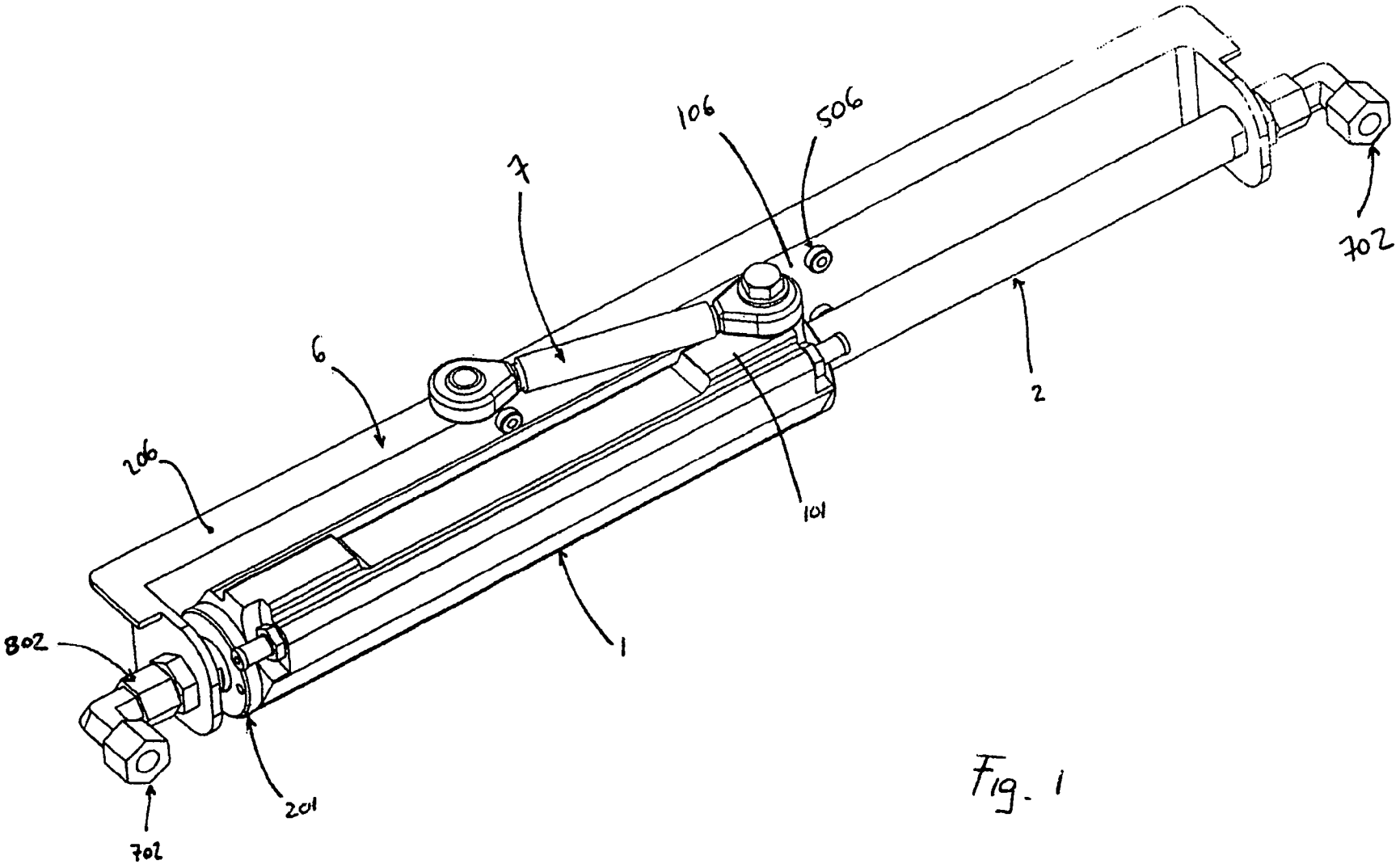
FIG. 1 is a front perspective view of a first preferred embodiment of the device of the invention.
Figure 7:
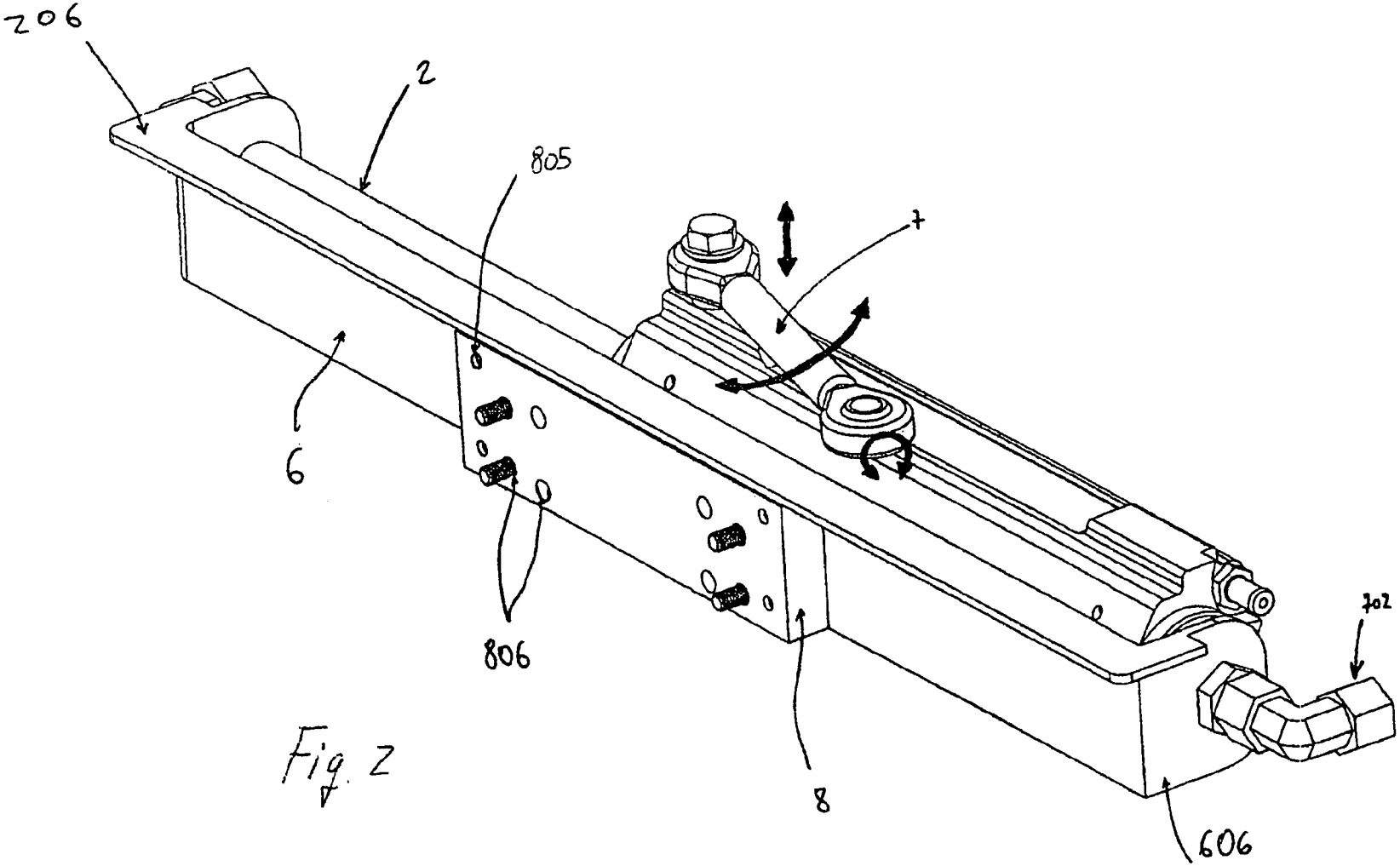

Particularly, FIGS. 1 and 2 show two (front and rear) perspective view of the present device, in which the support plate or bracket 6 is visible, which has a median portion forming the flat engagement seat 106. In the preferred embodiment of FIGS. 1 and 2, said seat has four successive holes 506 for fastening the plate or bracket to four threaded holes 805 of the block 8 on the rear of the plate, as shown in FIG. 2. The arrangement of the four slotted holes 806 and the size thereof are such as to allow engagement of the block 8 on the motor fastening end, by couplings provided on the clamp, and normally used for packaging, which are typically at least one pair of threaded holes, spaced from each other in a horizontal direction and substantially coincident with the holes 806 of the block 8. In order to enhance the adaptability of the block 8 to different positions of the threaded holes in the clamp or in the motor terminal, at least one of the holes of each pair of holes along a horizontal axis is shaped like a slot extending in said horizontal direction. However, when at least three holes are provided at the vertices of a triangle or four holes at the vertices of a quadrilateral, at least one of the holes or at least two of the holes, particularly two holes having different vertical positions may be slotted both in the horizontal and in the vertical directions, thereby having a cross shape. As is apparent from FIG. 1, the plate or bracket 6 has upper stiffening ribs 206.

The end portions 606 of the plate 6 are angled away from the motor and toward the cylinder 1, and have such a length as to hold the cylinder 1 at a distance from the plate 6, thereby allowing it to freely slide on the rod 2. Such angled terminal ends 606 of the plate 6 are fastened to the rod by specially shaped bolts. The upper rib 206 ends in the corner area, between the plate and the angled end at a certain distance from an end portion of the corresponding angled end 606 to allow easy coupling and attachment of the bolt for fastening the two portions of the rod 2 to the plate. In this embodiment, each end of the rod 2 is internally threaded and the rod is integrated in the bracket by specially shaped bolts 802. The bolt 802 has an internal hole for the passage of oil and the threaded shank engages the internal threading of the end of the half rod 302. The extension of the bolt head is externally threaded and has an internal tapered hole for sealing the fittings 702 which connect to the hydraulic fluid or oil circulation circuit. Such fittings can be radial clamping fittings or combinations of threaded fittings on one side and radial clamping fittings on the other side. The oil delivered by the pump which is controlled by the steering wheel or by a different control device, like a helm wheel or the like is introduced in one of the two chambers separated by the piston 502 directly through the corresponding portion of the tubular rod 202, 302, thereby providing a device in which the fluid inlets/outlets are fixed in position relative to the bracket 6 and to the watercraft. FIGS. 1 and 2 also show the cylinder 1 sliding along the rod 2, the cylinder being shown in its rightmost operating position. Thanks to the oil delivered by the pump, the cylinder slides from right to left and vice versa, thereby transmitting its translational motion to the arm 7 which is directly linked to the cylinder 1. FIG. 1 also shown the outer profile of the expansion chambers 101 and the heads 201. Regarding the arm 7, FIG. 1 shows it as having two different sections: a prismatic section, at the end portion of said arm and a round section at the start portion of the arm 7 which is coupled with the cylinder portion provided therefor, which is not visible in FIG. 1. Such arm 7 may be translated/rotated relative to the cylinder 1 in its round starting portion and may be further translated/rotated in its end portion, to provide the widest range of mounting solutions for coupling to the different motor types, as mentioned above.

Figure 3:
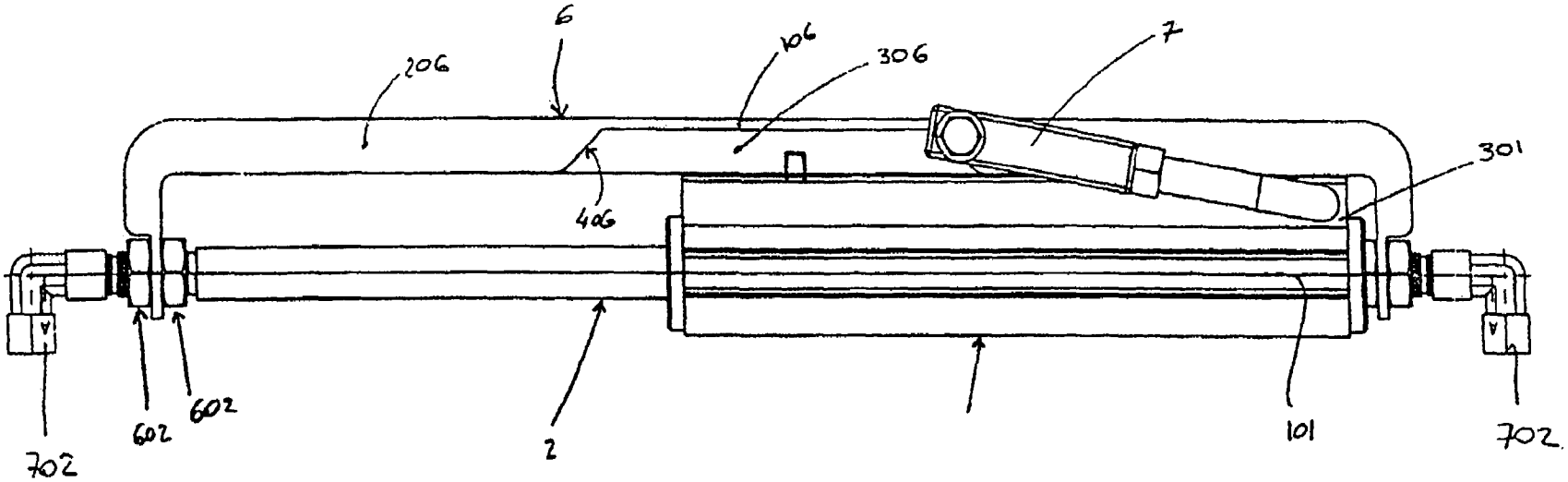
FIG. 3 is a top view of an alternative embodiment of the device of the invention.

FIG. 3 shows a top view of an alternative embodiment of the present device, wherein certain elements of FIGS. 1 and 2 are also shown. In this particular embodiment, the plate or bracket 6 has a flat engagement seat 106 which is offset relative to the side branches of the plate, whereby the block 8 of FIGS. 1 and 2 is no longer needed. Particularly in FIG. 3, a particular embodiment of the plate or bracket 6 is shown, which has the upper stiffening rib 206. The particular embodiment of the plate 6 causes the latter to be particularly light and sturdy, the ribs allowing to reduce the thicknesses of the plate, while maintaining a considerable flexural and torsional rigidity. From FIG. 3 the particular shape of the plate 6 and the upper rib 206 is apparent, the latter ending at a certain distance from the portion in which the rod 2 is engaged in one passage port at each of the angled ends 606 of the plate 6, thereby providing sufficient clearance to grasp the fastening bolt 802. It shall further be noted that the plate may also have a lower stiffening rib, not shown, in addition to the upper rib, which is substantially provided opposite to the upper rib, where said upper rib is lacking.

FIG. 3 also shows the fittings 702 for oil or hydraulic fluid, when fitted into the end portion of the rod 2.

Figure 4:
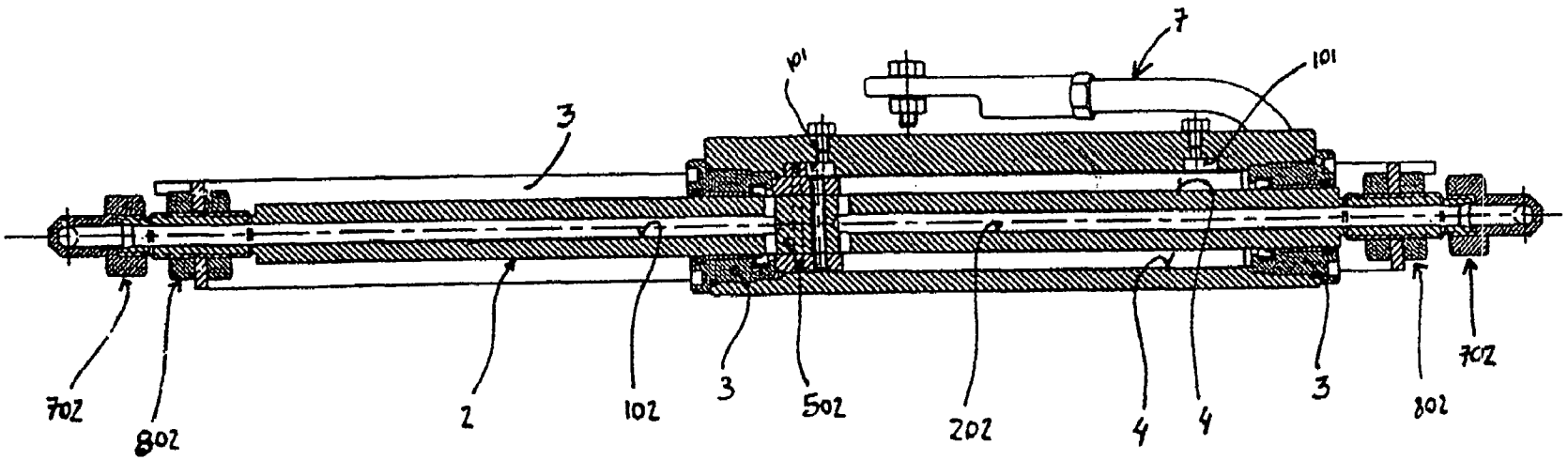
FIG. 4 is a front section view of the cylinder, the rod and relevant components according to the embodiment as shown in FIG. 3.

Referring now to FIG. 4, which shows a front section of the cylinder, the rod and all relevant parts, the tubular rod 2 sealingly and slideably projects out of both heads of the cylinder 1. Therefore, the rod 2 has a tubular shape and is preferably composed of two separate rod segments 202, 302, which are dynamically interconnected by a central piston 502. The latter divides the inner space of the cylinder into two chambers 4, 5. The conduits for feeding/discharging fluid to and from the corresponding chambers 4, 5 of the cylinder 1, which are formed by the two tubular right and left half-stems 202, 302 open into or communicate with the corresponding variable volume chamber 4, 5 of the cylinder 1 through at least one radial pipe, port or the like 402. The ports 402 of the embodiment as shown in FIG. 4 are formed by radial passageways in the body of each end of each half-stem 202, 302, at the connection with the piston 502 and are provided at the side of the piston 502 which is turned toward the outlet head of the corresponding half-stem 202, 302 of the cylinder 1. Nevertheless, the holes or passageways 402 of the half-stems 202, 302 for communication with the corresponding chambers 4, 5 may be provided as radial inclined holes, or with sections differing from the one of FIG. 4.

When the hydraulic fluid reaches the corresponding chamber 4, 5 the chamber volume increase, due to the admission of oil, causes the cylinder 1 to move along the rod 2, thereby generating the motion that will be transmitted to the arm 7 and will cause the outboard motor connected thereto to be steered. In fact, the oil or hydraulic fluid being used, due to the pressure generated by the pump, displaces the piston 502 that delimits the variable volume chambers 4 and 5, each chamber being delimited by the corresponding face of the piston 502 and the facing cylinder head.

Said chambers 4, 5 are delimited by the outer wall of the corresponding half-stem 202, 302, by the inner wall of the corresponding portion of the cylinder 1, by the corresponding wall of the piston 502 and by the corresponding head 3. Those skilled in the art will appreciate how the oil or hydraulic fluid volume increase causes an axial thrust on the corresponding head, which is movable for its being linked to the cylinder, and translates along the rod, thereby driving the cylinder 1. In the particular embodiment of FIG. 4, the heads 3 of the cylinder 2 are visible, which are connected to the latter by appropriate and known systems, or are made of one piece therewith. FIG. 4 also shows the various seals between the elements of the cylinder 1 and between the cylinder 1 and the rod 2, but the description of said seals is unnecessary, as they are well known to the skilled person.

Figure 5:
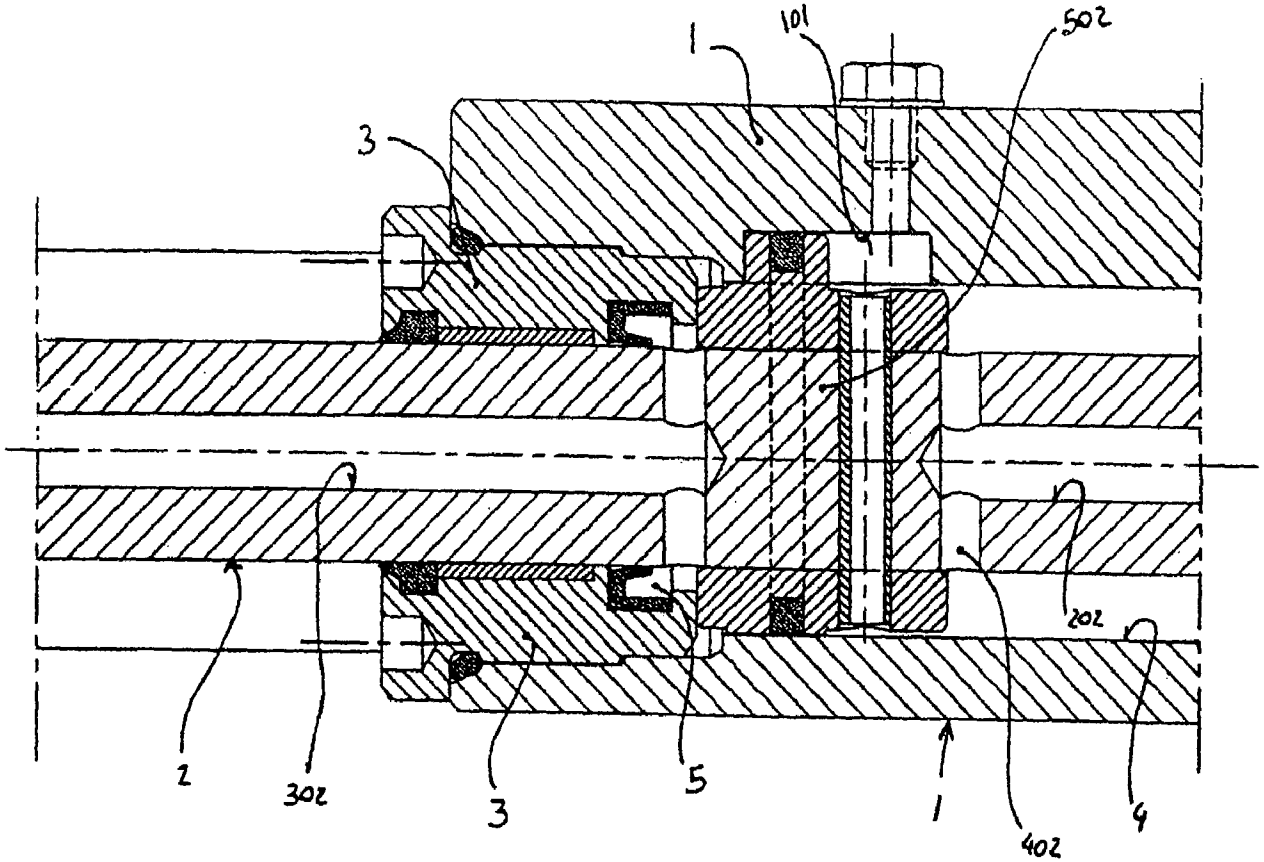
FIG. 5 is a cross section of a detail of FIG. 6, particularly of the portion around the piston.

FIG. 5 shows a section of a detail of FIG. 3, particularly of the area around the piston 502, which actually forms the end portion of each of the right and left feed pipes 202, 302 of the two half-stems. The piston 502 is directly attached to the rod 2 in a median position, and it may be noted that it also forms the fixed wall of the variable volume chambers 4 and 5. FIG. 5 also shows the plurality of seals between the various components of the device according to the present invention, although they will not be described herein, because said seals are prior art for those of ordinary skill.

Figure 6:
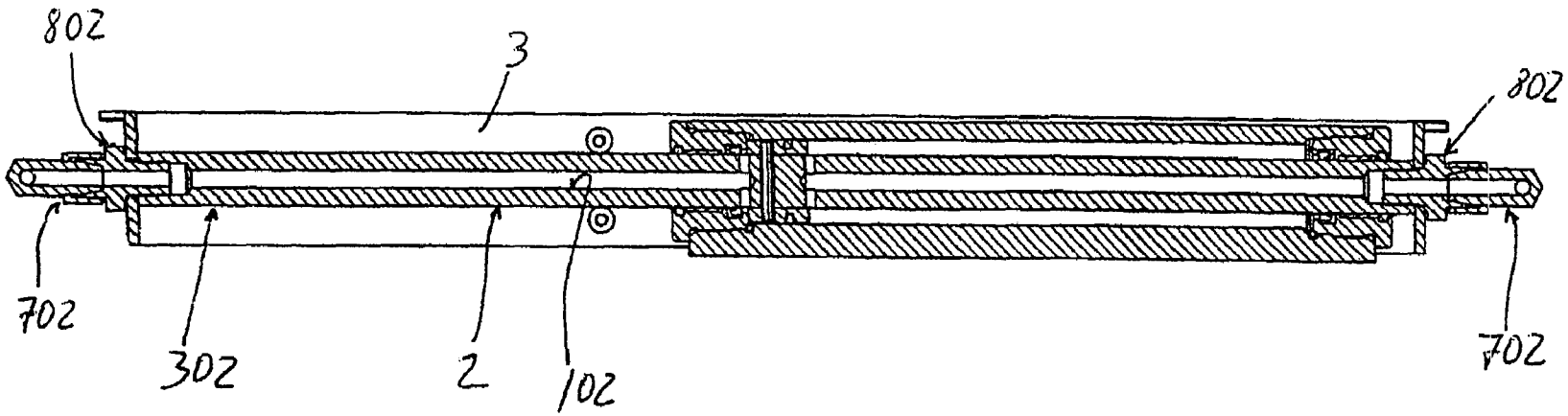
FIG. 6 is a front section view of the cylinder, the rod and relevant components according to the preferred embodiment of FIGS. 1 and 2.

FIG. 6 shows a front section view of the cylinder, the rod and the relevant parts of the preferred embodiment of FIGS. 1 and 2, this particular embodiment showing, in addition to the parts that were described for the previous figures, the particular shape of the bolt 802, which has threads engaging in the internal wall of the rod, as shown in FIG. 6. It shall be noted that, in this particular embodiment, the bolt 802 needs no locknut, which makes the device even lighter.

Referring to a further feature, which is apparent from FIGS. 1 to 5, the inner space of the cylinder has two expansion chambers 101 which are formed by a radial extension of the chamber of the cylinder 1 and are situated at a higher position than the rest of the cylinder chamber, and especially than the ends of the half-stems 202, 302. These expansion chambers have one, two or more bleeder valves 401, that are used as described above to bleed the hydraulic circuit and are mounted in the highest position of the circuit. As is shown in the Figures, the expansion chambers 101 are disposed over the cylinder 1 and, in the particular selected embodiment, they are disposed outside the cylinder, but they may be also provided within the cylinder, which makes them invisible from the outside. Thanks to this characteristic, the air within the circuit gathers in the expansion chambers 101 and may be easily bled by the bleeder valve.

Particularly referring to FIG. 1, the latter shows the arm 7 linked in its housing 301, which is itself provided, in the preferred embodiment, as a parallelepiped outside the cylinder 1 and possibly made of one piece therewith. Due to positioning needs, the arm 7 is movably coupled with its housing, the arm 7 being free to rotate within its housing 301, thereby allowing its free end to be variously positioned, and to be adapted to the different possible positions of the steering means, which are present on currently available outboard motors of different types. Also, FIG. 4 shows a preferred variant embodiment of the arm, said idler arm being composed of two parts, that are mutually engaged, preferably in a nut and screw arrangement, possibly by using a nut or another fastener, to also allow the arm to be extended, still with the aim of providing a more versatile use. Thanks to the connections in its housing 301, said arm may rotate about an axis perpendicular to the cylinder axis, may translate along such axis, thereby becoming raised from the cylinder, may rotate by its free end portion, thanks to the joint placed on the arm 7 and may be also extended, still thanks to said joint. The various degrees of freedom as described above are preferably provided by using a nut-and-screw type housing 301 on the cylinder 1, and an identical connection between the two arm parts. Thus, it will be appreciated that the free end portion of the arm may be easily and widely adjustable, as described above. FIG. 2 shows by black arrows the different degrees of freedom that the arm and its free end portion may have.

FIG. 4 shows an axial section of the cylinder, the rod and relevant parts, in which the perforated rod 2 is visible, which forms, thanks to the holes along the rod and the central piston 502, the two feeding/discharging conduits formed by the two right and left half-stems 202 and 302, which are fed with oil or hydraulic fluid, admitted through the two fittings 702 at the end portions of the rod. Through the two channels of the two half-stems, formed by the piston 502, oil or hydraulic fluid flows through the connection ports 402 into the variable volume chambers 4 and 5. The connection ports 402 in the embodiment as shown in FIG. 4 are provided by forming radial holes in the rod body at its piston end, although radial inclined holes may be formed, or having sections differing from that of FIG. 4. When the hydraulic fluid reaches the corresponding expansion chamber, the chamber volume increase, due to the admission of oil, causes the cylinder 1 to move along the rod 2, thereby generating the motion that will be appropriately transmitted to the arm 7 and will cause the outboard motor connected thereto to be steered. In fact, the oil of hydraulic fluid being used, due to the pressure generated by the pump, displaces the piston 502 that delimits the variable volume chambers 4 and 5, each chamber being delimited by the corresponding face of the piston 502 and the facing cylinder head. FIG. 4 also shows the various seals between the elements of the cylinder 1 and between the cylinder 1 and the rod 2, but the description of said seals is unnecessary, as they are well known to the skilled person. Still in FIG. 4, the screw coupling means 402 of the selected embodiment are shown, which connect the rod 2 to the plate or bracket 6, thereby holding the rod in position.

The invention claimed is:

1. A hydraulic steering device for marine outboard engines, which outboard engines have a clamping and/or gripping end for fastening them to the transom of a watercraft on which the motor and propeller assembly is mounted in such a manner as to rotate about a substantially vertical steering axis, and which steering device includes a closed hydraulic circuit having at least one pump driven by steering means, and at least one double-acting cylinder which is slideably fitted on at least one coaxial rod, which rod sealingly projects out of a cylinder head and carries a separating piston which divides the cylinder into two variable volume chambers, each of which chambers has a hydraulic fluid inlet/outlet, each being connected to one of two inlets/outlets of the pump and with sealing heads for the mutually sliding cylinder and rod which are made of one piece with the cylinder, to at least one plate or bracket for securing the cylinder and rod assembly to the transom and/or to the end for fastening the motor to the transom, the bracket being non-slideably attached to the at least one rod, at least one idler arm between the cylinder and outboard motor steering connection means which are integral with the motor, wherein: at least one of the inlets/outlets of at least one of the two cylinder chambers is formed by the at least one rod which has an axial hole extending from its outer end to one or more ports for communication with the corresponding chamber of the cylinder, which ports are arranged to be adjacent to the piston side turned toward the cylinder head wherefrom said rod projects.

2. A hydraulic steering device as claimed in claim 1, wherein it comprises a cylinder actuator having one rod projecting out of both cylinder heads and carrying an intermediate separating piston which divides the cylinder into two chambers and the rod into two coaxial half-stems, the inlets/outlets of each chamber being formed by a through hole of the associated half-stem, which hole extends to the outer end of said half-stern and opens into the corresponding chambers with ports adjacent to the wall of the separating piston, on the side thereof turned toward the corresponding outlet head of the cylinder half-stem.

3. A hydraulic steering device as claimed in claim 1, wherein the fastening plate or bracket possibly cooperates with a fastening block, wherein the fastening end and/or a fastening clamp and the fastening plate or bracket and/or the block of the cylinder and rod assembly are each provided with at least one hole.

4. A device as claimed in claim 1, wherein the cylinder includes at least one bleeder valve communicating with one of the cylinder chambers, and wherein said cylinder has at least one fixed volume expansion chamber in its upper portion, the at least one bleeder valve being connected thereto.

5. A hydraulic steering device as claimed in claim 1, wherein said cylinder has a housing for the idler arm, said housing consisting of a block situated outside the cylinder, possibly made of one piece therewith, which is perforated and possibly threaded.

6. A hydraulic steering device for marine outboard engines, which outboard engines have an end for fastening them to the transom of a watercraft, on which fastening end the motor/propeller assembly is mounted in such a manner as to rotate about a substantially vertical steering axis, and which steering device includes at least one double-acting cylinder which is slideably fitted on at least one rod, which rod projects out of at least one head of the cylinder actuator and is secured in a stationary manner to the transom and/or to the end for fastening the motor to the transom, by a fastening bracket or plate which possibly cooperates with a fastening block, wherein the fastening end and/or a fastening clamp and the fastening plate or bracket and/or the block of the cylinder and rod assembly are each provided with at least one hole, said holes being coincident with each other and the hole on the fastening end of the outboard motor being threaded and cooperating with a fastening means, wherein said plate is substantially slightly shorter than the rod, and has two angled portions at its ends, and two holes at the end of the angled portions, for the passage of the rod.

7. A hydraulic steering device as claimed in claim 6, wherein the end portions of said rod have means for attaching them to said end portions of said plate, which consist of threads on the outer surface of said rod, and of two retaining nuts, each on one of the two opposite sides of the ends of said plate.

8. A hydraulic steering device as claimed in claim 6, wherein said plate has a median engagement Seat for fastening said plate to the transom or to the clamp of the outboard motor or to the fastening block.

9. A hydraulic steering device as claimed in claim 6, wherein said plate has a stiffening rib along its edges, which is integral with the plate.

10. A hydraulic steering device as claimed in claim 6, wherein a stiffening rib is lacking in the upper portion of the engagement seat and is present in the upper portion of the bracket only in the portion around the engagement seat, while it niay be present in the lower portion of the engagement seat.

11. A hydraulic steering device as claimed in claim 6, wherein said plate is coupled to the fastening block and/or to the clamp for securing the outboard motor to the transom through holes, possibly having a slot shape, for the passage of the engagement means.

12. A hydraulic steering device as claimed in claim 6, wherein an engagement seat or said block has at least one hole, wherein at least some whereof are slot-shaped.

13. A hydraulic steering device as claimed in claim 6, wherein said engagement seat or said block has four holes.

14. A hydraulic steering device for marine outboard engines, which steering device includes a closed hydraulic circuit having at least one pump driven by steering means, and at least one double-acting cylinder which is slideably fitted on at least one coaxial rod, which rod sealingly projects out of a cylinder head and carries a separating piston which divides the cylinder into two variable volume chambers, each of which chambers has a hydraulic fluid inlet/outlet, each of which inlets/outlets is connected a corresponding inlet/outlet of the pump and with sealing heads for the mutually sliding cylinder and rod, which are made of one piece with the cylinder, at least one bleeder valve communicating with one of the cylinder chambers, wherein said cylinder has at least one fixed volume expansion chamber in its upper portion, the at least one bleeder valve being connected thereto.

15. A hydraulic steering device as claimed in claim 14, wherein said expansion chamber externally has the shape of a parallel pipe which rests on the upper portion of the cylinder when the latter is mounted in the operating position.

16. A hydraulic steering device as claimed in claim 14, wherein said expansion chamber has one, two or more bleeder valves.

17. A device as claimed in claim 14, wherein the expansion chamber consists of a radial extension of the central chamber of the cylinder.

18. A hydraulic steering device for marine outboard motors, which outboard motors have a clamping and/or gripping end for fastening them to the transom of a watercraft, on which fastening end the motor/propeller assembly is mounted in such a manner as to rotate about a vertical steering axis, which steering includes at least one cylinder actuator, at least one idler arm between the cylinder and outboard motor steering connection means which are integral with the motor/propeller assembly, wherein said cylinder has a housing for the idler arm, said housing consisting of a block situated outside the cylinder, possibly made of one piece therewith, which is perforated and possibly threaded.

19. A hydraulic steering device as claimed in claim 18, wherein said idler arm is inserted or screwed on said housing on the cylinder.

20. A hydraulic steering device as claimed in claim 18, wherein said idler arm is composed of two parts, which are mutually engaged by a nut and screw arrangement, possibly by using a nut or another fastener.

21. A hydraulic steering device as claimed in claim 18, wherein the idler arm portion turned toward the motor steering connection means has housings for coupling to said means of the outboard motor.

22. A hydraulic steering device as claimed in claim 18, wherein said arm is movable according to at least one degree of freedom.

23. A hydraulic steering device as claimed in claim 18, wherein said arm has means that allow it to rotate/translate inside the seat formed on the cylinder, and further has means thereon for translating/rotating the end portion of the arm relative to the arm body.

24. A hydraulic steering device as claimed in claim 18, wherein the housing for the idler arm is placed in its portion facing toward the motors.

25. A hydraulic steering device as claimed in claim 18, wherein said arm is movable according to three degrees of freedom.

26. A hydraulic steering device as claimed in claim 18, wherein said arm has means that allow it to rotate/translate inside the seat formed on the cylinder, wherein the means are bayonet joints, nut/screw joints, nut/locknut joints.

27. A hydraulic steering device as claimed in claim 18, wherein said arm has means thereon for translating/rotating the end portion of the arm relative to the arm body, wherein the means are nut/screw joints, nut/locknut joints and bayonet joints.

* * * * *